US006036024A

United States Patent [19]

Seidler

[11] Patent Number: 6,036,024

[45] Date of Patent: Mar. 14, 2000

[54] PACKAGE FOR CANDLE WITH PROTECTIVE COVER

[75] Inventor: David Seidler, Forest Hills, N.Y.

[73] Assignee: Sterling Development Holdings, Inc., New York, N.Y.

[21] Appl. No.: 09/300,982

[22] Filed: Apr. 28, 1999

[51] Int. Cl.[7] ..... B65D 25/54

[52] U.S. Cl. ..... 206/780; 206/485; 206/476; 431/291

[58] Field of Search ..... 206/779, 780, 206/426, 461–467, 470, 476, 485, 485.1, 434; 431/288, 289, 291

[56] References Cited

U.S. PATENT DOCUMENTS

| | | | |
|---|---|---|---|
| 3,206,013 | 9/1965 | Stone | 206/780 |
| 3,437,193 | 4/1969 | Freeman | 206/780 |
| 4,549,654 | 10/1985 | Tiesman | 206/486 |
| 5,261,535 | 11/1993 | Light et al. | 206/476 |
| 5,879,151 | 3/1999 | Schultz et al. | 431/291 |

*Primary Examiner*—Paul T. Sewell
*Assistant Examiner*—Luan K. Bui
*Attorney, Agent, or Firm*—Kramer Levin Naftalis & Frankel LLP

[57] ABSTRACT

A candle package includes a candle holder having a candle therein. The candle holder includes a container having a closed bottom and an open top. A plastic sheet having a bottom wall and opposing sidewalls with the sidewalls including corresponding cutout regions therein is provided. The bottom of the container is positioned to rest on the bottom wall of the sheet, with the sidewalls of the sheet extending upwardly from the bottom wall to capture the container therebetween, with portions of the container extending through the cutout regions. A cover sheet is positioned on top of the container. The cover sheet and sidewalls include corresponding interengaging devices to releasably lock the cover sheet on top of the container and to the sidewalls of the sheet.

20 Claims, 4 Drawing Sheets

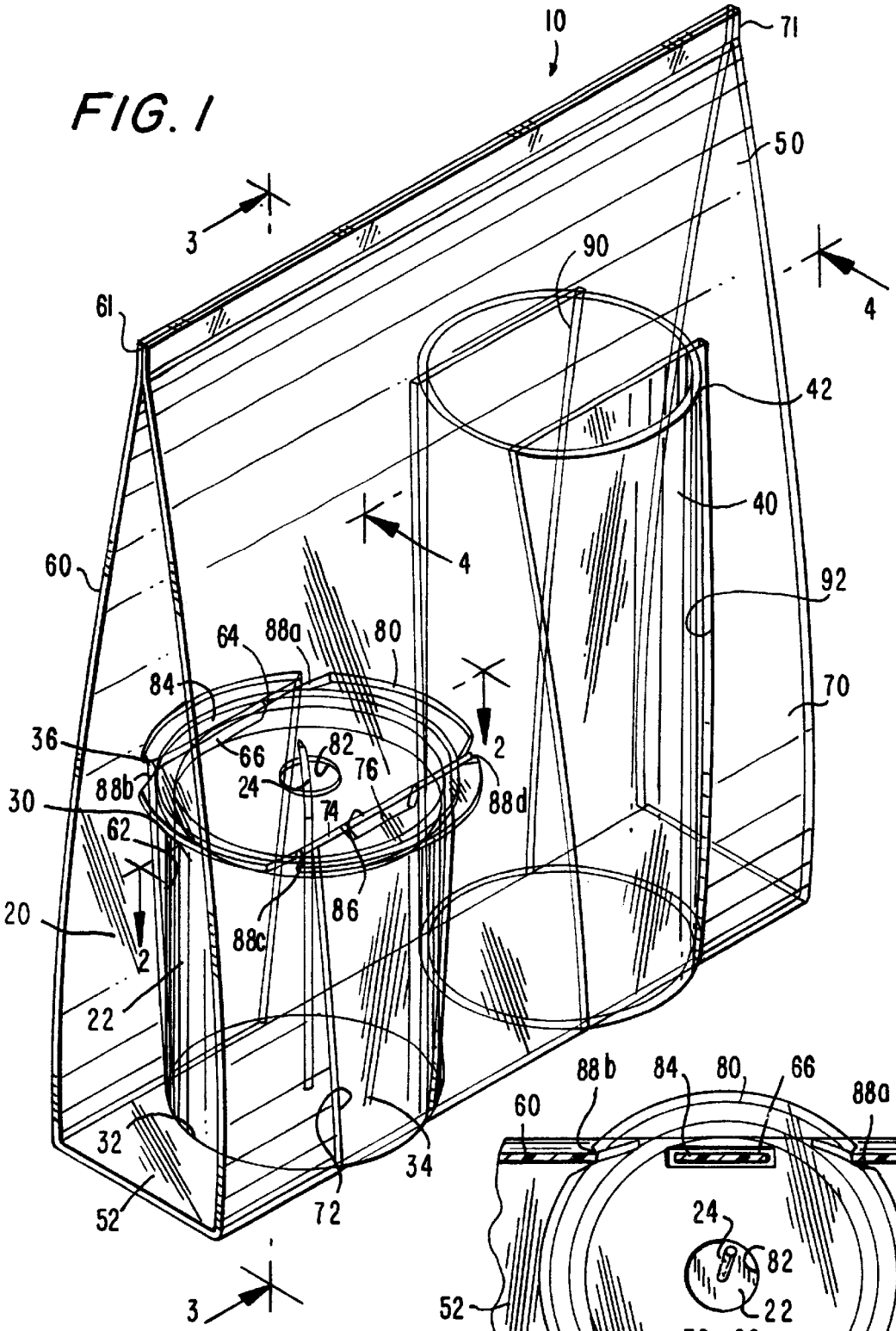
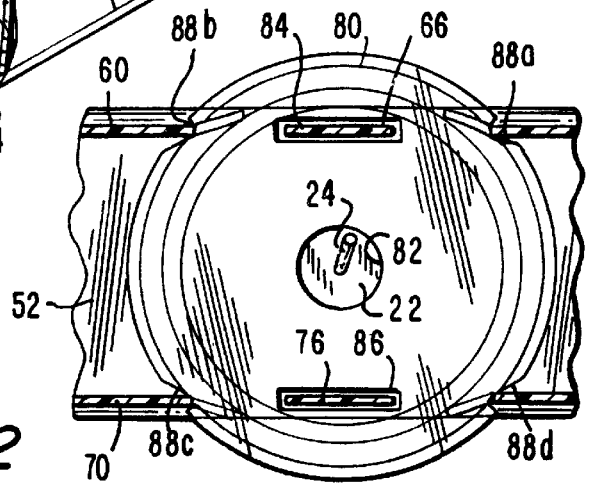
FIG. 2

PACKAGE FOR CANDLE WITH PROTECTIVE COVER

BACKGROUND OF THE INVENTION

The present invention is directed to a package for candle with protective cover and, in particular, to a package for a candle with a protective cover that allows the candle to be viewed while in the package when on display for retail sale, but which includes a protective cover to prevent touching of the candle material by consumers during display.

Candles come packaged in various packages. Candles of wax may be formed and sold in a container, or they may be formed and sold loose. Loose wax candles may be packaged in boxes or wrapped in plastic or paper material for sale. Likewise, candles provided in candle holders such as glass jars or the like may be provided in boxes or wrapped separately in plastic or paper material.

It is no doubt desirable that for candles formed from interesting or colorful materials or those in interesting or decorative holders, that such candles be exposed and made visible to consumers. One type of candle includes a candle material which can be formed in various colors and then poured into a clear candle holder such as a glass jar, beaker or the like with an open top. The clear holder allows the candle material to be visible through the holder, and when the candle material itself is translucent or transparent, a decorative and pleasing candle is provided. Indeed, it would be most desirable if such a candle holder could be presented to the consumer for purchase by leaving the candle holder with candle exposed for viewing by the consumer.

Because of the interesting appearance of the candle holder under discussion, consumers are prone to touch the top of the candle material to determine its texture and feel. Such action causes fingerprints to be formed on the top surface of the candle material thereby making the package less than completely desirable for subsequent purchase by other consumers. Also, an exposed candle will collect dust.

Accordingly, there is a strong need and desire for a candle package which, while protecting the candle material from touching and dust, also exposes the package and candle holder and material to the consumer for viewing. The present invention harmoniously provides such a package which meets the needs and desires noted above.

SUMMARY OF THE INVENTION

Generally speaking, in accordance with the present invention, a candle package is provided. The candle package includes a candle holder having a candle material therein, with the candle holder including a container having a closed bottom and an open top. The package further includes a plastic sheet having a bottom wall and opposing sidewalls, with the opposing sidewalls including corresponding cutout regions therein. The bottom of the container is positioned to sit on the bottom of the sheet, with the sidewalls of the sheet extending from the bottom wall to capture the container therebetween, with portions of the container extending through the cutout regions. A cover sheet is positioned on the top of the container, with the cover sheet and sidewalls including corresponding interengaging devices to releasably lock the cover sheet on the top of the container and to the sidewalls of the sheet.

In a preferred embodiment, the sheet is formed from a clear acetate or other plastic material, and is folded to form a triangular package. Corresponding tabs and grooves are formed on the sheet cut out regions and cover sheet to releasably hold the cover sheet to the sidewalls.

Accordingly, it is an object of the present invention to provide an improved package for a candle.

Another object of the present invention is to provide a package for a candle holder which exposes the candle holder for view.

Yet another object of the present invention is to provide a package for a candle holder in which the top of the candle holder is covered to prevent touching of the candle material therein.

A still further object of the present invention is to provide a simple to form package for a candle which is easy to assemble and inexpensive to manufacture.

Still other objects and advantages of the invention will in part be obvious and will in part be apparent from the specification.

The invention accordingly comprises the features of construction, combination of elements, and arrangements of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a perspective view of a package for a candle constructed in accordance with a first embodiment of the present invention;

FIG. 2 is an enlarged sectional view taken along line 2—2 of FIG. 1;

DETAILED DESCRIPTION OF THE PREFERRED EMBODIMENTS

Figure 3:
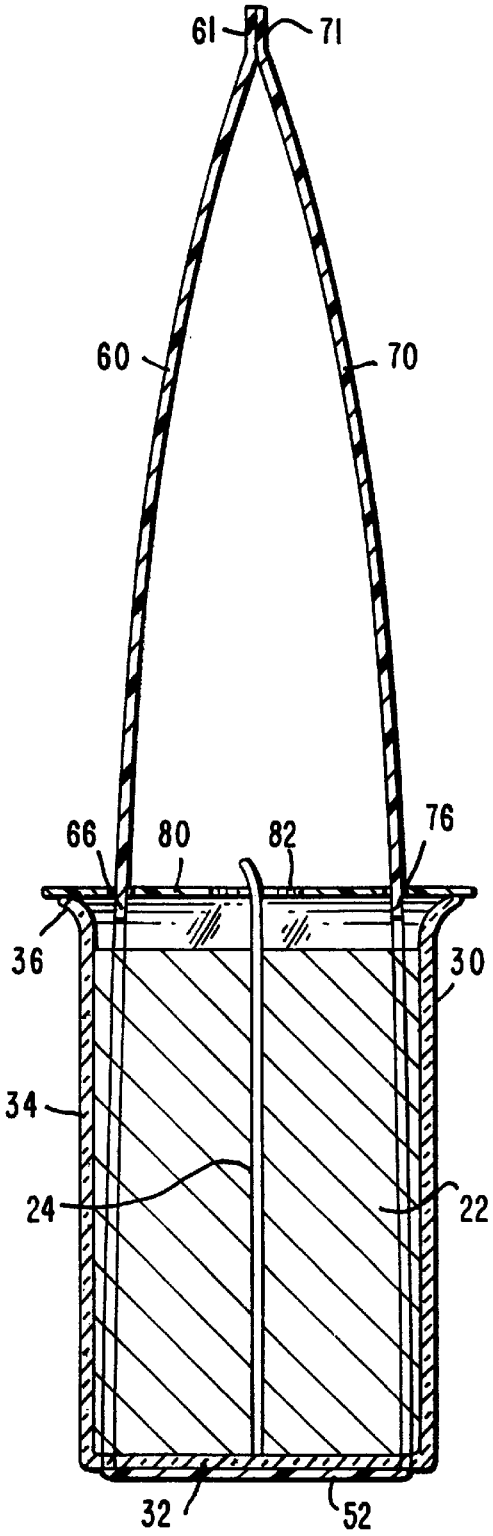
FIG. 3 is a sectional view taken along line 3—3 of FIG. 1.
Figure 4:
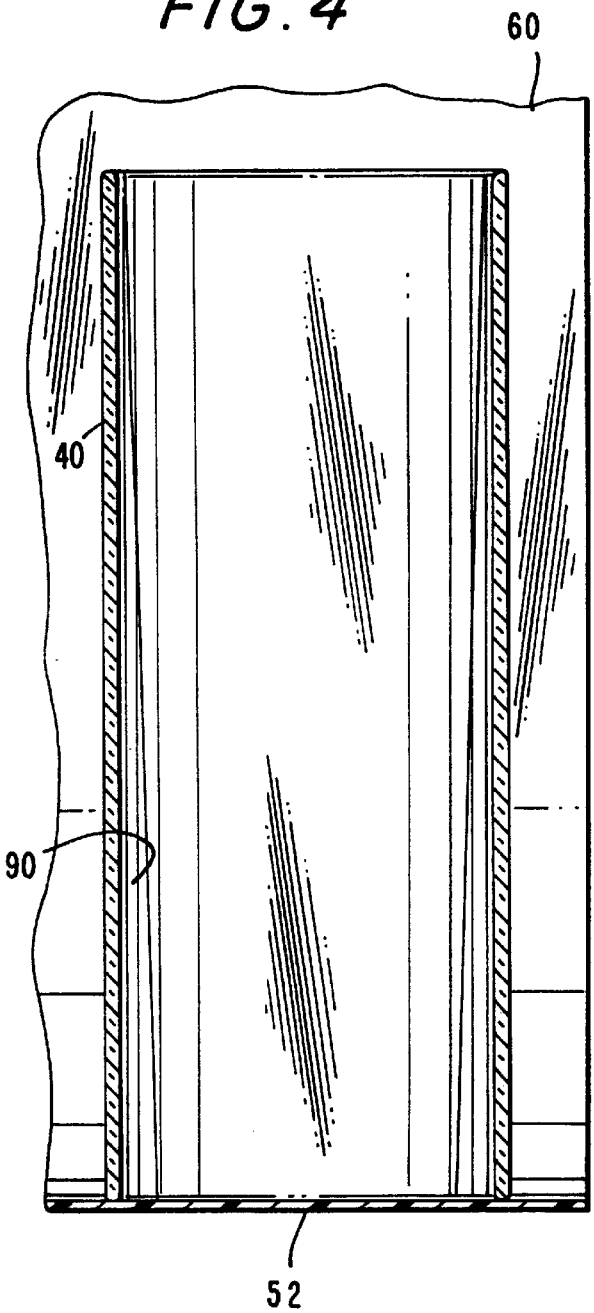
FIG. 4 is a sectional view taken along line 4—4 of FIG. 1.

Reference is first made to FIGS. 1 through 4 of the drawings which depict a package, generally indicated at 10, constructed in accordance with a first embodiment of the present invention. Package 10 is used to package (i) a candle 20 which includes candle material 22 having a wick 24 extending therethrough supported in a candle holder 30, and (ii) an elongated candle column 40.

Candle material 22 is preferably colored in a desired color and is also preferably essentially clear or translucent. This allows wick 24 to be visible through the candle material. It is recognized however that candle material may be opaque.

Candle holder 30 is preferably formed from a clear or colored glass material in the form of a cup or beaker and includes a circular bottom wall 32 a cylindrical side wall 34 and a top circular lip 36 which extends slightly outwardly from sidewall 34 as best depicted in FIG. 3. It is noted that candle holder can be formed in any shape as desired and from any suitable material.

In the embodiment depicted in FIG. 1, candle column 40 is utilized to support candle 20 in a raised position during use after both are removed from the package. In this regard, during use, candle holder 30 is placed in the upper open end 42 of candle column 40, and lip 36 maintains candle holder 30 at the top of candle column 40.

The package of the present invention includes sheet of plastic material 50 preferably formed from a transparent acetate material. Sheet 50 is folded as depicted to form a triangular shape as shown and includes a bottom wall 52 with upstanding opposing sidewalls 60 and 70. Each of sidewalls 60 and 70 include corresponding cutout regions 62 and 72. Top wall 64 of cutout region 62 includes a downwardly extending tab 66, and top wall 74 of cutout region 72 includes a downwardly extending tab 76.

A separately formed transparent disk 80 preferably formed from the same acetate material as sheet 50 is provided and positioned as depicted to form a cover sheet for the candle. Disk 80 includes a central opening 82 which allows air to circulate, corresponding slots 84 and 86 adapted to receive corresponding tabs 66 and 76 of sheet 50, and corresponding undercuts 88*a*, 88*b*, 88*c* and 88*d* which are adapted to engage with cutout regions 62 and 72 as will described below in detail.

Elongated openings 90 and 92 are provided respectively in sidewalls 60 and 70 to accommodate candle column 40. This allows candle column 40 to be co-packaged with candle 20 which then may be sold as a unit.

In order to assemble the package of the present invention, sheet 50 is formed and cutouts 62, 72, 90 and 92 are formed therein. Candle 20 is manufactured 20 including candle holder 30, and candle column 40 is also manufactured. Sheet 50 is folded as depicted in FIGS. 1 through 4 thereby enclosing candle 20 and candle column 40 therebetween, with portions thereof extending respectively through the cut out regions. Disk 80 is placed on top of candle 20 and tabs 66 and 76 are inserted into corresponding slots 84 and 86 while undercuts 88*a* through 88*e* engage their respective cut out regions. In this fashion, disk 80 as a cover sheet is essentially locked on top of candle holder 30. Free ends 61 and 71 of sidewalls 60 and 70, respectively, can then be sealed or joined at the top thereof using a desired adhesive material, or simply by using an adhesive tab or strip to hold the two free ends together thereby forming the triangular shape of the package.

Since candle holder 30 is securely positioned between sidewalls 60 and 70 of sheet 50, and since disk 80 is securely positioned on top of candle holder 30, a decorative package is provided which allows full visibility of the candle, but which prevents touching of the candle material. As aforenoted, opening 82 in disk 80 allows out air circulation around the candle material.

Figure 5:
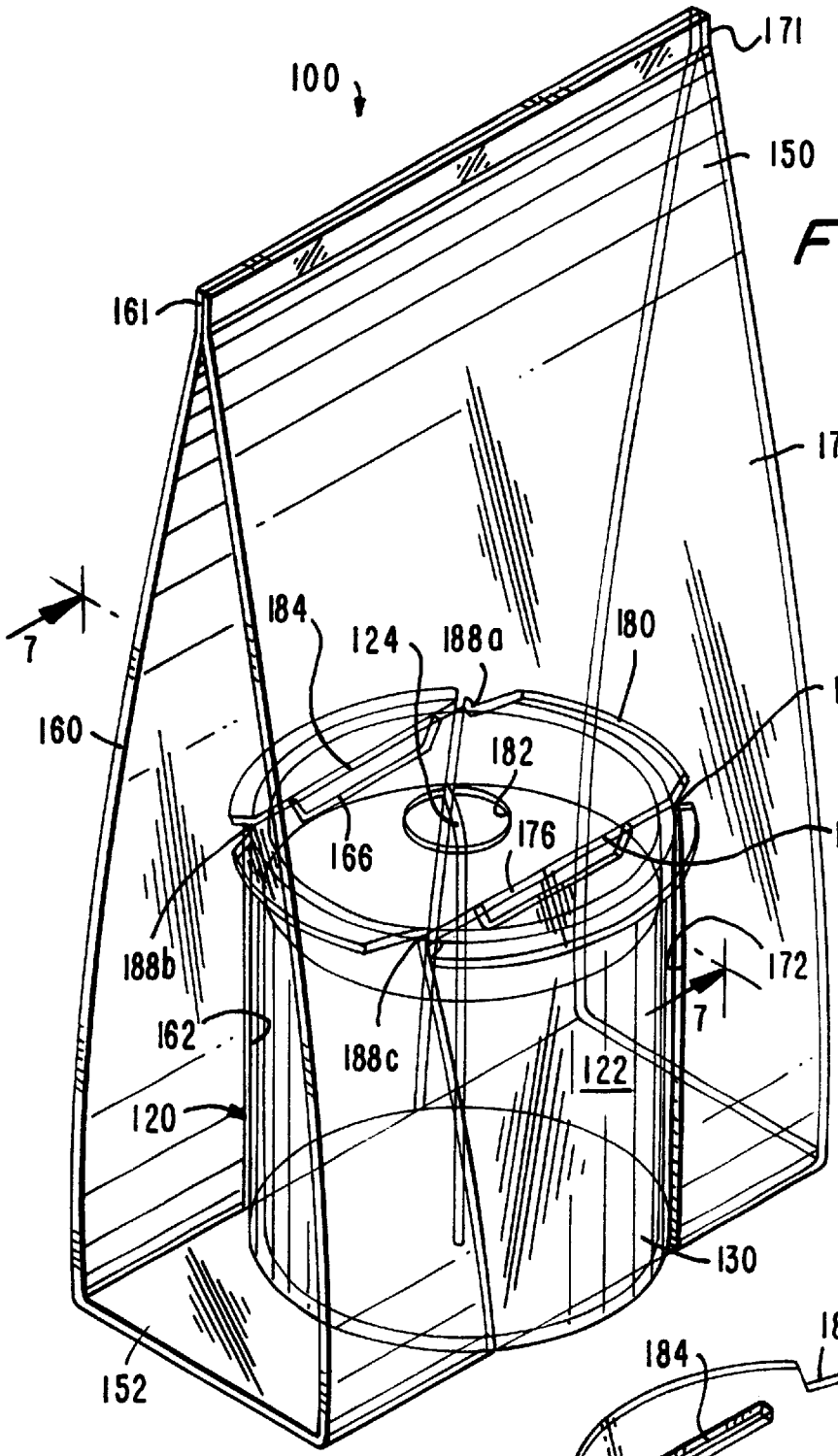
FIG. 5 is a perspective view of a package for a candle constructed in accordance with the second embodiment of the present invention.
Figure 6:
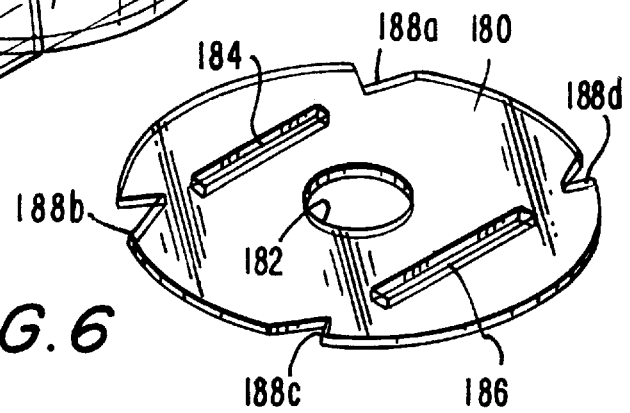
FIG. 6 is a perspective view of the cover sheet for the candle package depicted in FIG. 5.
Figure 7:
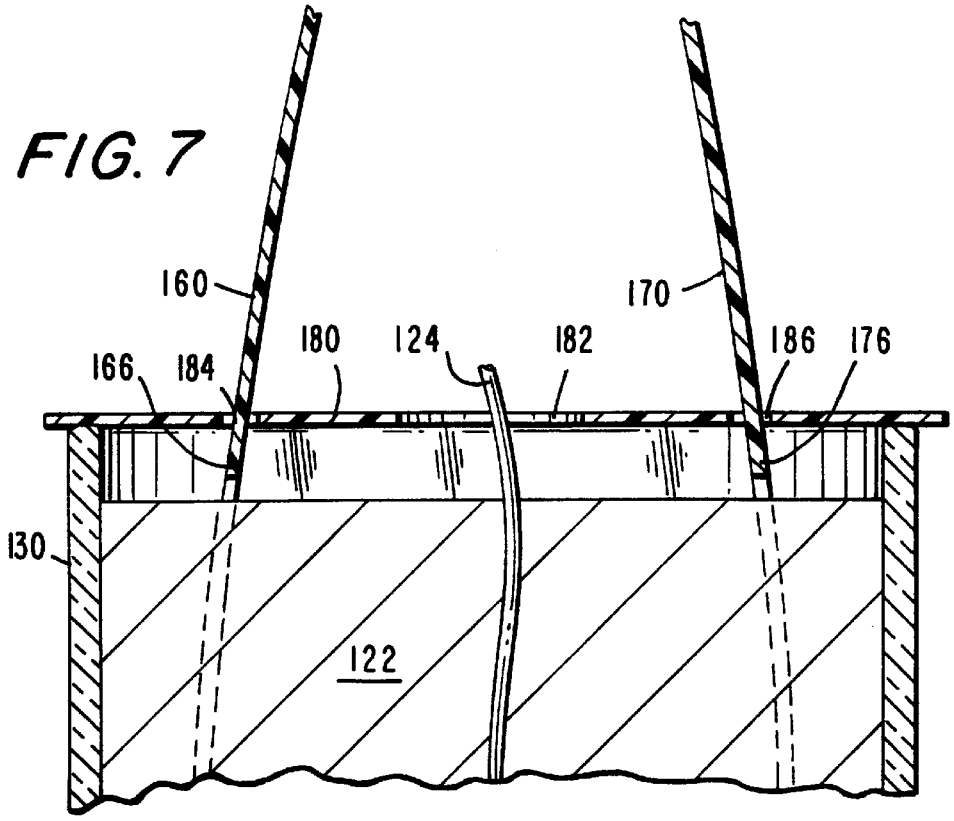
FIG. 7 is an enlarged sectional view taken along line 7—7 of FIG. 5.

Reference is now made to FIGS. 5 through 7 of the drawings which depict a candle package, generally indicated at 100 constructed in accordance with an alternative embodiment of the present invention in which only a candle in a candle holder is packaged, without a candle column. Candle package 100 includes a plastic sheet 150 preferably formed from a transparent acetate material which includes a bottom wall 152 and opposing sidewalls 160 and 170. Sidewall 160 includes a cutout 162 and sidewall 170 includes a corresponding cutout 172.

Candle 120 includes a candle holder 130 holding a candle material 122 having a wick 124 extending therethrough. Disk 180 is formed as depicted and includes a central opening 182, slots 184 and 186, and undercuts 188*a*, 188*b*, 188*c* and 188*d*.

Package 100 is formed and assembled as described above with respect to FIGS. 1 through 4. Disk 180 is positioned and locked on top of candle holder 130 by the interaction of slots 184 and 186, respectively with tabs 166 and 176 in conjunction with undercuts 188*a* and 188*b* locking in cutout 162 while undercuts 188*c* and 188*d* lock and interact with cutout 172 on sidewall 170. Upper free ends 161 and 171 of sidewalls 160 and 170 are appropriately coupled to one another using adhesive or other known fastening means.

Figure 8:
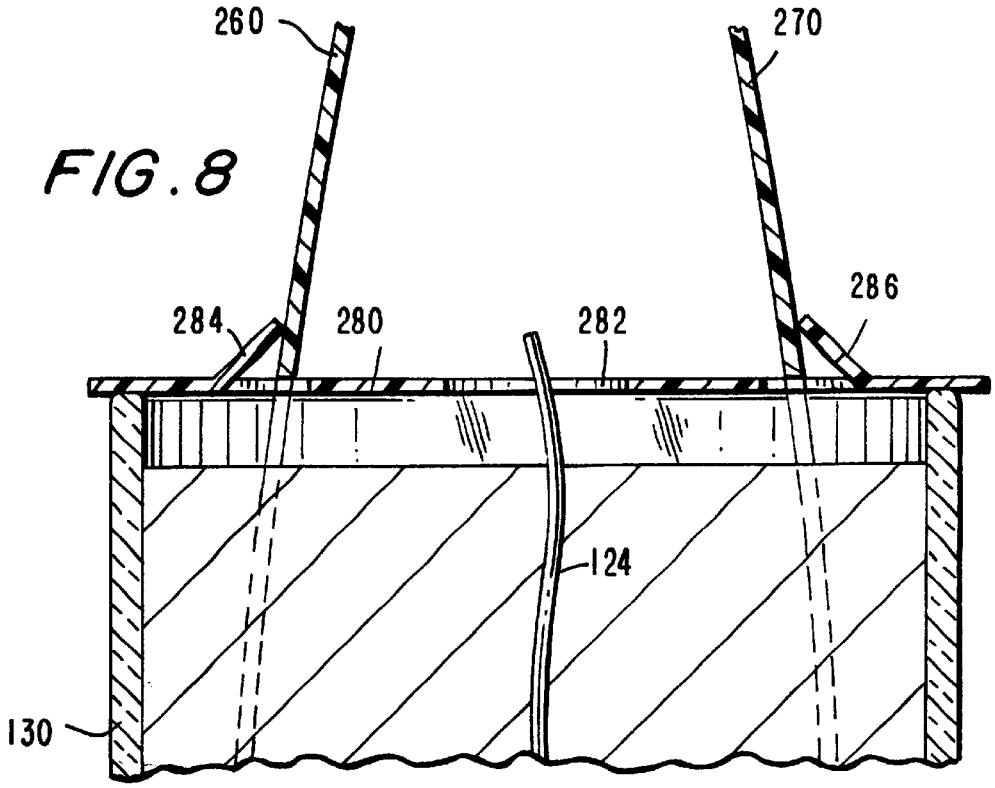
FIG. 8 is an enlarged sectional view similar to FIG. 7 but showing an alternative embodiment of the corresponding locking system.

Referring now to FIG. 8, it is seen that other methods for securing cover sheet or disk 280 on top of candle holder 130 may be used. In the embodiment depicted in FIG. 8, cover sheet 280 include tabs 284 and 286 which are formed by cutting corresponding elongated slots in cover 280. Tabs 284 and 286 rest respectively against sidewalls 260 and 270 of the candle package to hold the sidewalls in position while at the same time holding cover 280 on candle holder 130. Undercuts may also be formed to assist in the interengaging of the components.

The candle package of the present invention provides a decorative, preferably transparent package for a candle formed in a candle holder. The package allows full visibility of the candle holder, yet provides a protective cover to prevent touching of the candle and to also prevent dirt, dust and the like from soiling the candle material. The package is simple and inexpensive to manufacture, and its pleasing and decorative appearance should enhance the visibility and sales of the products packaged therein.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A package for a candle in a candle holder comprising an outer sheet having a bottom wall and opposing sidewalls, said opposing sidewalls having opposing cutout regions therein to accommodate the shape of said candle holder, a cover sheet to cover the top of said candle holder, said cover sheet and said outer sheet having cooperating means for releasably holding said cover sheet on the top of said candle holder and for releasably holding the opposing sidewalls of said outer sheet in a position to capture said candle holder therebetween.

2. The package as claimed in claim 1, wherein said cooperating means includes tabs on one said sidewalls and cover sheet and corresponding slots on the other said sidewalls and cover sheet which interengage with said tabs.

3. The package as claimed in claim 2, wherein said tabs are positioned on said sidewalls and said slots are correspondingly formed in said cover sheet, said tabs extending into said corresponding slots.

4. The package as claimed in claim 3, wherein said opposing cutout regions each include a top edge, one said tab being formed on each said top edge.

5. The package as claimed in claim 4, wherein said slots are positioned on said cover sheet to correspond to the positions of said tabs.

6. The package as claimed in claim 5, wherein said cover sheet includes undercuts to releasably lock said cover sheet to said sidewalls.

7. The package as claimed in claim 1, wherein said cooperating means includes tabs on said cover sheet.

8. The package as claimed in claim 7, wherein said tabs are positioned adjacent said respective sidewalls.

9. The package as claimed in claim 8, wherein said tabs rest against said sidewalls.

10. The package as claimed in claim 9, wherein said tabs are formed in said cover sheet by cutting corresponding slots therein.

11. The package as claimed in claim 1, wherein said opposing sidewalls each have a free end, said free ends being coupled together.

12. The package as claimed in claim 11, wherein said free ends of said sidewalls are coupled together using an adhesive material.

13. The package as claimed in claim 1, wherein said outer sheet is formed from a plastic material.

14. The package as claimed in claim 13, wherein said plastic material is essentially transparent.

15. The package as claimed in claim 14, wherein said plastic material is acetate.

16. A candle package comprising a candle holder having a candle therein, said candle holder including a container having a closed bottom and an open top, a plastic sheet having a bottom wall and opposing sidewalls, the bottom of said container being positioned to sit on said bottom wall of said sheet, the sidewalls of said sheet extending from said bottom wall to capture said container therebetween, a cover sheet positioned on the top of said container, said cover sheet and sidewalls including corresponding interengaging devices to releasably lock said cover sheet on the top of said container and to the sidewalls of said sheet.

17. The candle package as claimed in claim 16, wherein said interengaging devices are corresponding tabs and slots.

18. The candle package as claimed in claim 16, wherein said interengaging devices are tabs.

19. The candle package as claimed in claim 16, wherein said sheet forms a triangular package.

20. The candle package as claimed in claim 19, wherein said sheet is essentially transparent.

* * * * *